US005196109A

United States Patent [19]

Scott

[11] Patent Number: 5,196,109

[45] Date of Patent: Mar. 23, 1993

[54] TRIVALENT CHROMIUM ELECTROLYTES AND PLATING PROCESSES EMPLOYING SAME

[76] Inventor: Geoffrey Scott, 530 Tashua Rd., Trumbull, Conn. 06611

[21] Appl. No.: 738,886

[22] Filed: Aug. 1, 1991

[51] Int. Cl.[5] ..... C25D 3/06

[52] U.S. Cl. ..... 205/289; 205/287; 205/290

[58] Field of Search ..... 205/287, 289, 290

[56] References Cited

U.S. PATENT DOCUMENTS

| | | | |
|---|---|---|---|
| 3,833,485 | 9/1974 | Crowther et al. | 204/43 R |
| 4,142,948 | 3/1979 | Tajima et al. | 204/43 R |
| 4,221,832 | 9/1980 | Philippe et al. | 427/319 |
| 4,432,843 | 2/1984 | Tremmel | 204/51 |
| 4,448,648 | 5/1984 | Barclay et al. | 204/51 |
| 4,473,448 | 9/1984 | Deeman | 204/51 |
| 4,673,471 | 6/1987 | Kagechika et al. | 204/44.5 |
| 4,810,336 | 3/1989 | Martyak | 204/51 |

FOREIGN PATENT DOCUMENTS 2048928 4/1972 Fed. Rep. of Germany .

OTHER PUBLICATIONS

Chemical Abstract 105:104632k, Sep. 22, 1986.
Chemical Abstract 77:13281g, Jul. 10, 1972.

*Primary Examiner*—John Niebling
*Assistant Examiner*—Brian M. Bolam
*Attorney, Agent, or Firm*—Kramer, Brufsky & Cifelli

[57] ABSTRACT

An improved aqueous acidic trivalent chromium electrolyte and process for increasing the tolerance thereof to the presence of deleterious contaminating metal ions and organic impurities which normally progressively increase during commercial operation of the electrolyte ultimately resulting in chromium electrodeposits which are commercially unsatisfactory due to the presence of streaks, clouds, and hazes in the deposit. The improved composition contains an effective amount of at least one EDTA compound which is effective to mask the adverse effects of such contaminating metal and organic impurities and which also enhances the codeposition of such metal contaminants on the parts being plated thereby reducing, and in some instances, preventing the accumulation of such contaminating metal ions in the electrolyte.

14 Claims, No Drawings

TRIVALENT CHROMIUM ELECTROLYTES AND PLATING PROCESSES EMPLOYING SAME

BACKGROUND OF THE INVENTION

The present invention relates to improved trivalent chromium electrolytes, and more particularly to an improved trivalent chromium electrolyte composition which is substantially more tolerant to the presence of deleterious contaminating metal ions such as nickel, zinc, iron, copper and lead as well as organic contaminants such as excess organic wetting agents or brighteners, which accumulate and progressively increase in concentration during normal commercial operation of the plating bath. When one or more of such metal ion impurities attain concentration levels in which they are present in even relatively trace quantities, the chromium electrodeposit is adversely affected by the presence of black streaks, clouds and hazes which are sometimes further accompanied by a loss or reduction in covering power rendering such chromium electrodeposits commercially unsatisfactory. Similarly, excessive organic contaminants can give rise to the presence of white streaks thereby flawing the resulting deposit.

In recognition of the problem associated with extraneous metal ions and organic contamination of such trivalent chromium plating baths, it has heretofore been proposed in accordance with U.S. Pat. No. 4,038,160 to add small amounts of water soluble ferrocyanide compounds to the plating solution to effect a precipitation of such contaminating metal ions which thereafter are removed by filtration. While such proposed ferrocyanide treatment has been found effective in many instances, the treatment is costly and time consuming and the ferrocyanide precipitating agent itself can adversely affect the performance of the trivalent chromium electrolyte when employed in amounts that leave a residual excess of the precipitating agent dissolved in the bath. This necessitates further treatment by the intentional addition of contaminating metals to effect a precipitation of the excess precipitating agent.

It has also been proposed to remove such contaminating metal ions through an electrolytic purification and peroxide treatment technique by which the bath is electrolyzed over a period of time employing a cathode on which a codeposition of the contaminating metal ions is effected. Unfortunately, while such an electrolytic purification technique is somewhat effective for reducing copper ion contamination, it is relatively ineffective for removing nickel and zinc ions and is only partially effective for removing iron.

Other techniques have been proposed for the removal of extraneous metal ions and organic contamination. For example, U.S. Pat. No. 4,432,843 suggests the use of thiazole and benzothiazole compounds. This treatment is relatively costly and time consuming and therefore has not proven successful.

The present invention provides an improvement over such prior art techniques by providing a trivalent chromium electrolyte which is more tolerant to the presence of one or more of such contaminating metal ions or organic contaminants masking or hiding their deleterious effects thereby providing for a longer useful operating life of the bath under normal commercial operating conditions. Additionally, the present invention enhances the codeposition of such contaminating metal ions thereby substantially reducing the rate of buildup of the concentration of such contaminating ions during the normal commercial operation of the bath. In those instances in which the rate of contamination is relatively low, such enhanced codeposition is adequate in and of itself to prevent accumulation of such metal ions to levels at which deleterious results are obtained. The present invention further contemplates a method for rejuvenating or restoring the performance of a trivalent chromium electrolyte which has been detrimentally affected by the accumulation of such contaminating metal ions whereby the concentration thereof is reduced restoring the electrolyte to commercially satisfactory operating conditions.

Additionally, the present invention enhances the deposit's ability to be color buffed after plating. Prior trivalent chromium electrolyte formulations as described, for example, in U.S. Pat. No. 4,473,448 result in chromium electrodeposits which exhibit poor color buffing properties. A 0.3 mil nickel plated brass Hull cell test panelplated for three minutes at 5 amps with the electrolyte of the '448 patent was color buffed using an 8282 cloth wheel and Lea Rok scratchless pink coloring composition. Upon examination, the panel exhibited areas wherein the chromium deposit was removed revealing the nickel underplate. When the additive of the present invention was added in the amount of 30 g/l to the electrolyte of the '448 patent (Ex. 1 with thiourea) and a 0.3 mil nickel plated brass Hull cell test panel was plated for 3 minutes at 5 amps, the resulting panel was color buffed in the same manner as described above. Upon examination, the panel exhibited no areas of cut through and the chromium deposit remained intact. It is important to note that while both examples provided commercially acceptable deposits, the ability to color buff afforded by the additive of the present invention indicates a harder and/or thicker deposit is obtained.

SUMMARY OF THE INVENTION

The benefits and advantages of the present invention are achieved by admixing a bath soluble additive agent with an aqueous acidic trivalent chromium electrolyte, preferably a trivalent chromium electrolyte of the type disclosed in U.S. Pat. No. 4,473,448, the disclosure of which is incorporated herein by reference. However, it is currently believed that the additive agent of the present inventon can be advantageously employed in other trivalent chromium electrolytes such as that disclosed, for example, in U.S. Pat. No. 4,432,843, and the like.

The bath soluble additive agent of the present invention is employed in such electrolyte in an effective amount sufficient to increase the tolerance of the electrolyte to the presence of deleterious contaminating metal ions and organic contaminants.

The additive agent of the present invention is ethylenediaminetetraacetic acid (also known as ethylenedinitrilotetraacetic acid) and its mono-, di-, tri-, and tetra alkali metal and alkaline earth metal salts hereinafter referred to collectively as the "EDTA additives". The EDTA additives of the present invention have the following structural formula:

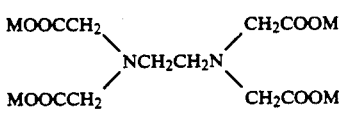

(I)

wherein M is hydrogen, an alkali metal or an alkaline earth metal.

Depending upon the valence of the metal ion or ions employed, these EDTA additives can take the form of a metal chelate such as, for example, ethylenediaminetetraacetic calcium disodium chelate having the formula:

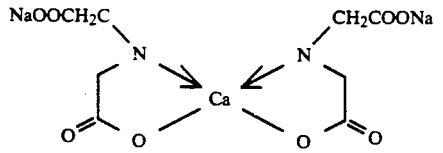

(II)

For purposes of this invention, compounds of formula (I) and chelates of formula (II) are considered equivalent and will be hereinafter referred to collectively as "EDTA additives" and represented by formula (I).

In accordance with the process aspects of the present invention, a trivalent chromium electrolyte of improved tolerance to contaminating metal ions and organic impurities is produced by the addition to the electrolyte of an effective amount of one or more bath soluble and compatible EDTA additives of the foregoing type. Similarly, the present invention contemplates a process for restoring or rejuvenating a trivalent chromium electrolyte which has been rendered deficient in its ability to deposit commercially satisfactory chromium platings due to the accumulation of deleterious contaminating metal ions such as by the drag-in of contaminating solutions, the attack and dissolution of the substrate of the metal articles being processed, and/or the impurities present in the water and chemicals employed for replenishing the bath. With the EDTA additives of the present invention, commercially satisfactory deposits can be obtained immediately without the need to codeposit contaminating metal ions onto a cathode. Nor is down time due to lengthy purification treatments required.

The EDTA additives of the present invention can be employed in amounts as low as about 0.1 g/l to amounts as high at about 200 g/l or higher depending upon the specific EDTA additive or combination of EDTA additives employed without adverse effects to the plating performance of the trivalent chromium electrolyte. The presence of excess EDTA additives in the electrolyte is not detrimental to the bath since the additive progressively depletes during normal electrolysis of the bath.

Additional benefits and advantages of the present invention will become apparent upon a reading of the description of the preferred embodiments taken in conjunction with the specific examples provided.

DESCRIPTION OF THE PREFERRED EMBODIMENTS

The trivalent chromium electrolyte in accordance with the present invention contains trivalent chromium ions which range in concentration from about 0.01 to about 1.0 molar, and preferably from about 0.4 to about 0.6 molar. The trivalent chromium ions are suitably introduced in the form of any simple aqueous soluble and bath compatible salt such as chromium chloride hexahydrate, chromium sulfate, and the like.

The electrolyte further contains a dissolved complexing agent selected from Classes I to V as described in U.S. Pat. No. 4,473,448 and which are summarized below.

The relative molar concentration of the trivalent chromium to the complexing agent is always greater than 1:1 and is usually greater than 1:0.1, many of such agents being effective at a considerably higher chromium ratio of 1:0.01 or 1.0.001 or in some cases even more.

In practice, the chromium ion concentration will usually lie within the range of from about 0.01 to 1.0 molar. Correspondingly, such dissolved complexing agents will usually be present in amounts from 1 to 500 milligrams per liter, more especially 10 to 100 mg/l.

Preferably the complexing agent will be organic and sulfur-containing.

Class I compounds as defined herein consist of those compounds with an

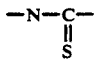

group within the molecule. Preferably, these are either a thiocyanate in salt or ester form or a compound which can be expressed by the formula:

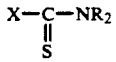

wherein X is either (a)—R,—S or —$NR_2$ or (b) represents another group of the formula

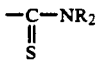

linked to the first by —S— or —S—S—; the R group being the same or different and chosen from hydrogen, straight or branch chain alkyl, alkenyl, or alkenyl groups, and mononuclear or binuclear carbocyclic aromatic groups, R being either unsubstituted or substituted by a carboxylic acid group or a salt or ester thereof.

The organic compounds should be water soluble. Usually therefore they will be relatively low molecular weight (e.g. less than 300) so that R is preferably hydrogen or at most, possesses not more than six carbon atoms; for example, $C_1$ to $C_3$ alkyl. Specific compounds suitable for use in accordance with Class I in the present invention include: sodium thiocyanate, thiourea, N-monoallyl thiourea, N-mono-p-tolyl thiourea, thioacetamide, tetraethyl thiuram disulfide, sodium diethyldithiocarbamate, and the like.

The organic compounds described above can be used in combination with one another.

Class II compounds consist of compounds of formula (X)—$SO_2$—(Y) in which X is (a) a saturated or unsaturated two or three carbon atom aliphatic group terminating in a mercapto group or (b) the disulfide corresponding thereto, of formula Y—($SO_2$)—X S—S—X(-$SO_2$)—Y or (c) a single unsubstituted benene ring; and Y is—ONa,—OH,—$NH_2$ or when X is a single unsubstituted benzene ring, a direct —NH— linkage or indirect —N—H—CO linkage to the ortho position thereof.

Specific compounds of utility in Class II are, for example, sodium allyl sulfonate, sodium vinyl sulfonate, mercaptopropane sulfonic acid, bis-(propylsulfuric acid)disulfide, benzene sulfonamide, thiamazole, saccharin, and the like.

All of the above compounds posses a sulfonic or sulfonamide group attached to a simple short-chain mercapto-containing group or to a single unsubstituted benzene ring.

Class III compounds consist of the compounds of formula $HOOC—(CH_2)_n—S_m—(CH_2)_n—COOH$ where n or m is 1 or 2. Preferred examples are dithiodiglycollic acid and thiodiglycollic acid.

Class IV compounds are similar to Class III and consist of the compounds of formula:

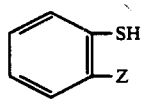

where Z is a water-solubility-conferring group e.g. —COOH, —OH or $SO_3H$. The aromatic ring linkage between, for example, the —COOH and the —SH groups appears to give an effective product.

All of the above organic compounds, of Classes I to IV are inter-related in that they possess either one or more thiol groups, or groups electrochemically related thereto.

Class V of these compounds is not organic but inorganic and consists of the sodium salts of acids of sulfur, selenium and tellurium from the list comprising metabisulfite, dithionite, sulfide, selenite, selenite, tellurate and tellurate.

The trivalent chromium electrolyte can optionally and preferably further contain a buffering agent in an amount of about 0.15 molar up to its limit as set by bath solubility with amounts typically ranging up to about 1 molar. Preferably, the concentration of the buffering agent is controlled from about 0.45 to about 0.75 molar calculated as boric acid. The use of boric acid as well as the alkali metal and ammonium salts thereof as the buffering agent also is effective to introduce borate ions into the electrolyte which have been found to improve the covering power of the bath. Alternatively, or additionally, one or more other buffering agents can be present, for example a carboxylic acid or a carboxylic acid salt such as citrate, tartrate, malate, formate or acetate.

Additionally, a wetting agent or mixtures of wetting agents can optionally and preferably be employed which can be of any of the types conventionally employed in nickel and conventional hexavalent chromium electrolytes. Such wetting agents can be anionic or cationic and are selected from those which are compatible and do not adversely affect the performance of the trivalent chromium electrolyte. Typically, wetting agents which can be satisfactorily employed include sulfosuccinates such as sodium dihexyl-sulfosuccinate, sodium lauryl sulfate, sodium 2-ethylhexyl sulfate, and alkyl ether sulfates alone or in combination with other compatible anti-foaming agents such as, for example, octyl alcohol. The inclusion of such wetting agents has been found to contribute toward the attainment of clear chromium deposits eliminating dark mottled deposits and to provide for improved coverage in low current density areas. Typically, such wetting agents can be employed in concentrations of up to about 10 grams per liter with amounts of about 0.05 to about 1 g/l being preferred.

To increase the conductivity of the electrolyte solution and hence reduce the power consumption required for chromium electrodeposition, conductivity salts can be added. These are desirable but not essential and so can vary in concentration from zero to saturation. Typical conductivity salts are salts of alkali or alkaline earth metals with strong acids for example chlorides or sulfates of potassium or sodium. Ammonium ions can also be useful in increasing conductivity and also can provide some buffering action.

Trivalent chromium electrolytes of the foregoing types are generally aqueous acidic solutions and contain hydrogen ions in a concentration to provide a pH on the acid side. Usually, the concentration of hydrogen ions is controlled to provide a pH of about 1.5 up to about 5.5, with a pH range of about 2.5 to about 4.0 being particularly satisfactory.

During commercial operation of such trivalent chromium electrolytes, a progressive contamination of the electrolyte occurs as a result of drag-in, dissolution in the electrolyte of the surfaces of the work pieces being plated, tank linings, work rack dissolution, causing a progressive buildup in the concentration of ions such as nickel, zinc, iron, copper and lead. It has been found by experimentation. that concentrations of nickel ions in amounts of about 150 ppm or higher are harmful and cause defects in the chromium electrodeposit. While the presence of iron ions in amounts up to about 500 ppm are beneficial in that they tend to promote coverage of the chromium deposit, concentrations of about 1,000 ppm are harmful to the chromium deposit. Similarly, concentrations of copper ions in amounts above about 15 ppm and zinc ions above about 10 ppm and higher are harmful. Lead is harmful above about 5–10 ppm. However, it is usually not a problem in sulfate—containing electrolytes since lead ions precipitate out as the insoluble lead sulfate salt and can be removed by filtration. When combinations of such metal ions and organic impurities are present in the bath, the harmful effects are cumulative and lower concentrations of the individual metal ions produce defects in the chromium deposit which are generally evidenced by the appearance of black streaks, clouds, and hazes. Under severe contaminating conditions, the covering power of the electrolyte is also adversely affected.

In accordance with the present invention, it has been discovered that by admixing effective amounts of one or more EDTA additives with the electrolyte, the tolerance of the electrolyte is unexpectedly increased with respect to the presence of such contaminating metal ions and organic contaminants enabling commercially satisfactory chromium deposits to be obtained due to a masking or hiding effect of the additive. The use of the EDTA additives further substantially prolongs the useful operating life of the electrolyte necessitating less frequent treatments with precipitating agents or peroxide treatments to remove such harmful metal ions and organic contaminants when their concentrations increase to objectionable levels. Additionally, the use of the EDTA additives further promotes a codeposition of such metal ions, particularly nickel and iron ions during a normal electrolysis of the bath during plating operations which may be sufficient in and of itself for maintaining the contaminating ion concentration at acceptable levels under conditions of relatively mild contamination. The removal of nickel ions by electrolysis is particularly significant in that such trivalent chromium platings are normally deposited on nickel plated substrates which tend to promote contamination of the electrolyte with nickel ions. The EDTA additives of the present invention comprise one or more bath soluble and compatible EDTA compounds or chelates of the structural formula:

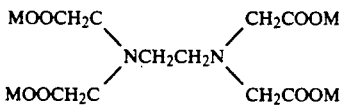

wherein M is hydrogen, an alkali metal or an alkaline earth metal. Thus, the EDTA additives of the present invention encompass EDTA, per se, and the mono-, di-, tri- and tetra alkali metal and alkaline earth metal basic salts thereof. For example, ethylene diaminetetraacetic acid, ethylenediaminetetraacetic acid disodium salt, ethylenediaminetetraacetic acid tripotassium salt, ethylenediaminetetraacetic acid tetracalcium salt, ethylenediaminetetraacetic acid monomagnesium salt, and the like are suitable for purposes of the present invention. The addition of the EDTA additives in amounts as low as about 0.1 g/l has been found to provide a beneficial effect in the performance of the electrolyte. Usually, amounts of about 15 to about 30 g/l are employed. It has been observed that when the concentration of the additive reaches about 200 g/l or greater, an objectionable yellow color deposit is obtained in the low current density areas of the object being plated. The maximum concentration of the additive that can be employed will vary depending upon its specific structural formula, the conditions under which the electrolyte is operated and the configuration of the parts being plated. Since concentrations of the additive in amounts as high as about 200 mg/l and higher do not appear to provide any appreciable benefits in the control of the effects of contaminating metal ions present, it is usually preferred to maintain the concentration of such additive at levels below about 100 g/l. The presence of amounts of the additive in excess of that required to control the contaminating metal ions and/or organic impurities present has been found not to produce any detrimental effects in the performance of the electrolyte as the excessive additive is progressively depleted during normal electrolysis of the bath. Accordingly, a periodic replenishment of the additive can be effected along with the other active constituents in the electrolyte to maintain its concentration within the desired range.

The beneficial results of the present invention are also obtained employing the EDTA additives of the present invention in other trivalent chromium electrolytes such as those generally and specifically described in U.S. Pat. Nos. 3,954,574; 4,107,004; 4,169,022, 4,196,063, and 4,432,843 the disclosures of which are incorporated herein by reference.

A particularly preferred form of the electrolyte of the present invention comprises trivalent chromium ions, a water-soluble organic compound of Class I, both borate and a buffer other than borate, a conductivity salt, a wetting agent, and an EDTA additive. The preferred electrolyte is formulated in a hydrogen concentration which affords an appropriate pH less than 4.5.

The presence of incidental amounts of other organic or inorganic species is acceptable if they do not affect the plating to an undesirable extent. The solution cannot, however, tolerate a large amount of hexavalent chromium and it may be necessary to add a suitable reducing agent, for example a bisulfite, formaldehyde, glyoxal or more especially a sulfite e.g. as sodium sulfite, to convert hexavalent chromium to trivalent chromium. This treatment may be necessary particularly, if the solution is to be used directly in contact with an inert anode since oxidation of trivalent chromium to hexavalent chromium can occur on electrolysis.

The bath may conveniently be made up by dissolving water-soluble salts of the required inorganic species and salts or other suitable water-soluble forms of the organic species in sufficient water to afford the required concentration.

Preparation of the bath can be accomplished at room temperature though it is preferable to heat the solution to about 50° C. to increase the rate of dissolution of the solid species.

In another aspect of the present invention, an electroplating process is provided in which a workpiece (preferably a metal workpiece) is immersed in a solution as described above and an electric current is passed through the solution from a compatible anode to the workpiece as a cathode whereby there is produced an electrodeposited chromium plate. Use of this process can give light colored electrodeposits similar in appearance to those obtained from solutions containing hexavalent chromium values.

The operating temperature of the solution of the present invention is preferably from 10° to 90° C., e.g. 40°-60° C. 50° is considered optimum. Current densities between 40 and 250 amperes per square foot can be employed and 40 to 100 amperes per square foot can be considered as preferred. If the pH of the solution during operation varies outside the recommended range, control can be accomplished by addition of, for example, hydrochloric or sulfuric acids or of, for example, sodium, potassium or ammonium hydroxide.

During operation of the process, it may be advantageous to separate the anode from the solution by a layer of inert material having a porous structure of the type that provide slow permeability to the passage of liquids and low resistance to the passage of electric current. Alternatively an ion-selective membrane can be used. The insulating effect should not however be excessive. Such procedures are preferable if chloride or other halide ions are present in the solution.

It will be appreciated that the low organic content of the solution simplifies the effluent treatment after the plating process.

The trivalent chromium electrolyte can be employed to plate chromium on conventional ferrous or nickel substrates, stainless steels, as well as on nonferrous substrates such as aluminum and zinc. The electrolyte can also be employed for chromium plating plastic substrates which have been subjected to a suitable pretreatment according to well-known techniques to provide an electrically conductive coating thereover such as a nickel or copper layer. The work pieces to be chromium plated are subjected to conventional pretreatments in accordance with well-known prior art practices and the electrolyte is particularly effective for depositing chromium platings on conductive substrates which have been subjected to a prior nickel plating operation.

The process of the present invention also contemplates a rejuvenation of a metal ion and/or organic impurities contaminated trivalent chromium electrolyte, the performance of which has been rendered deficient to produce commercially satisfactory chromium deposits. The performance of the electrolyte is restored by the addition of the EDTA additive. The inclusion of effective amounts of the EDTA additive has been found particularly effective in reducing nickel ion contamination at levels above about 150 ppm.

In order to further illustrate the benefits of the present invention, the following specific examples are provided. It will be understood that these examples are provided for illustrative purposes only and are not to be construed as limiting the scope of the present invention as herein disclosed and as set forth in the appended claims.

COMPARATIVE EXAMPLE 1

A 325 gallon production plating tank was filled with a trivalent chromium electrolyte of the following composition:

| | |
|---|---|
| Total Chromium* | 7.4 g/l |
| Boric Acid | 65.3 g/l |
| Thiourea | 260 mg/l |
| Sodium 2-ethyl hexyl sulfate (40%) | 1 ml |
| Water to | 1 liter |

*Chromium was supplied to the electrolyte using ENVIROCHROME liquid concentrate, i.e., a commercially available mixture comprising chromium sulfate and sodium sulfate (16.2% chromium) available from Frederick Gumm Chemical Company, Inc., Kearny, New Jersey.

Contamination of the electrolyte was as follows:

| | |
|---|---|
| Iron | 320 ppm |
| Copper | 65 ppm |
| Nickel | 96 ppm |
| Zinc | 128 ppm |

A 3"×4" inch 267 ml brass Hull cell panel was plated to a thickness of about 0.3 mil in a conventional Watt's type bright nickel bath. The panel was water rinsed and placed in the aforementioned contaminated trivalent chromium electrolyte for a period of 3 minutes at a current density of 80 ASF. The resulting chromium deposit was bright with average coverage but had dark streaks over the entire panel. The dark streaks rendered the plating commercially unsatisfactory and is believed due to the high metallic impurity content.

EXAMPLE 2

To the trivalent chromium electrolyte as described in Example 1 containing the contaminating metal ions, 25 g/l of EDTA disodium salt was added and the panel plating test repeated under the same conditions as previously described. The color of the electrolyte changed from a bluish green to purple. The resulting chromium deposit was uniformly bright with excellent coverage and no dark streaking. The chromium deposit was commercially satisfactory.

COMPARATIVE EXAMPLE 3

The test panel plated in Comparative Example 1 was color buffed to determine if the dark streaking could be buffed out of the deposit. Upon examination after the color buffing operation, the chromium deposit was removed and the nickel underplate was evident.

EXAMPLE 4

The test panel plated in Example 2 was color buffed to determine if the EDTA additive enhanced the resulting deposit thickness and/or hardness. Upon examination after the color buffing operation, the chromium deposit was intact and there were no signs of the nickel underplate.

COMPARATIVE EXAMPLE 5

A trivalent chromium electrolyte of a composition as described in Comparative Example 1 was made up and contained no metallic ion contamination. A conventional 3"×4" 267 ml brass Hull cell panel was plated in a conventional Watt's type bright nickel bath, water rinsed, and plated in a Hull cell containing the trivalent chromium electrolyte at 5 amperes for 3 minutes. The resulting chromium deposit was bright with 90% coverage but had some dark streaking in the low current density (LCD) area. The panel was then color buffed to determine if a non-metallic ion contaminated chromium deposit could be color buffed without removing the deposit and revealing the nickel underplate. Upon examination after the color buff operation, the chromium deposit exhibited many areas of total removal revealing the nickel underplate.

EXAMPLE 6

A trivalent chromium electrolyte of a composition as described in Comparative Example 1 was made up and contained no metallic ion contamination. To this electrolyte, 30 g/l of EDTA disodium salt was added. A nickel plated panel as described in Example 5 was placed in a Hull cell and plated at 5 amperes for 3 minutes. The resulting chromium deposit was uniformly bright with 93% coverage and no dark streaking. The panel was then color buffed to determine if the additive enhanced the chromium deposit's ability to be color buffed. Upon examination after the color buff operation, the chromium deposit was intact and there were no signs of the nickel underplate.

COMPARATIVE EXAMPLE 7

To the trivalent chromium electrolyte described in Example 5, 25 ml of wetting agent (sodium 2-ethylhexyl sulfate 40% solution) was added. A nickel plated panel as described in Example 5 was placed in a Hull cell containing the above solution and plated at 5 amperes for 3 minutes. The resulting chromium deposit was bright with 90% coverage but had white streaking in the low current density (LCD) area, which rendered the deposit commercially unaccceptable.

EXAMPLE 8

The electrolyte in Comparative Example 7 was modified by the addition of 10 g/l EDTA disodium salt and a repeat of the plating test produced a chromium deposit which was uniformly bright with 90% coverage and no streaking and was of commercially acceptable quality.

EXAMPLE 9

To the electrolyte as described in Comparative Example 1, 25 g/l of ethylenediaminetetraacetic acid (EDTA) was added and the panel plating test repeated under the same conditions previously described. The resulting chromium deposit was uniformly bright with excellent coverage and no dark streaking. The chromium deposit was commercially satisfactory.

EXAMPLE 10

To the electrolyte as described in Comparative Example 1, 25 g/l of EDTA trisodium salt was added and the panel plating test repeated under the same conditions previously described. The resulting chromium deposit was uniformly bright with excellent coverage and no dark streaking. The chromium deposit was commercially satisfactory.

EXAMPLE 11

To the electrolyte as described in Comparative Example 1, 25 g/l of EDTA tetrasodium salt was added and the panel plating test repeated under the same conditions previously described. The resulting chromium deposit was uniformly bright with excellent coverage and no dark streaking. The chromium deposit was commercially satisfactory.

EXAMPLE 12

To the electrolyte as described in Comparative Example 1, 25 g/l of EDTA calcium disodium salt was added and the panel plating test repeated under the same conditions previously described. The resulting chromium deposit was uniformly bright with excellent coverage and no dark streaking. The chromium deposit was commercially satisfactory.

EXAMPLE 13

To the electrolyte as described in Comparative Example 1, 25 g/l of EDTA dipotassium salt was added and the panel plating test repeated under the same conditions previously described. The resulting chromium deposit was uniformly bright with excellent coverage and no dark streaking. The chromium deposit was commercially satisfactory.

EXAMPLE 14

To the electrolyte as described in Comparative Example 1, 5 g/l of EDTA disodium salt and 5 g/l EDTA tetrasodium salt were added and the panel plating test repeated under the same conditions previously described. The resulting chromium deposit was uniformly bright with excellent coverage and no dark streaking. The chromium deposit was commercially satisfactory.

EXAMPLE 15

To the electrolyte as described in Comparative Example 1, 10 g/l of EDTA disodium salt and 10 g/l EDTA dipotassium salt were added and the panel plating test repeated under the same conditions previously described. The resulting chromium deposit was uniformly bright with excellent coverage and no dark streaking. The chromium deposit was commercially satisfactory.

EXAMPLE 16

To the electrolyte as described in Comparative Example 1, 5 g/l of EDTA disodium salt and 5 g/l EDTA calcium disodium salt were added and the panel plating test repeated under the same conditions previously described. The resulting chromium deposit was uniformly bright with excellent coverage and no dark streaking. The chromium deposit was commercially satisfactory.

What is claimed is:

1. An aqueous acidic trivalent chromium electrolyte consisting essentially of trivalent chromium ions, a water soluble complexing agent for maintaining the trivalent chromium ions in solution, and at least one bath soluble EDTA additive present in an effective amount sufficient to increase the tolerance of the electrolyte to the presence of deleterious contaminating metal ions and organic contaminants, said EDTA additive being of the structural formula:

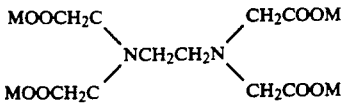

wherein M is hydrogen, an alkali metal or an alkaline earth metal.

2. The electrolyte as defined in claim 11 in which said EDTA additive comprises ethylenediamintetraacetic acid disodium salt.

3. The electrolyte as defined in claim 1 further containing bath soluble and compatible conductive salts present in an effective amount up to the solubility limit thereof in the electrolyte.

4. The electrolyte as defined in claim 1 further containing borate ions.

5. The electrolyte as defined in claim 1 further containing a wetting agent in an amount up to about 10 g/l.

6. The electrolyte as defined in claim 1 having a pH of about 1.5 to about 5.5.

7. An aqueous acidic trivalent chromium electrolyte consisting essentially of about 0.01 to about 1.0 molar trivalent chromium ions, a water soluble complexing agent for maintaining the trivalent chromium ions in solution present in a molar ratio of chromium ions to complexing agent of greater than 1:1, a buffering agent present in an amount of from 0.15 molar to the solubility limit thereof in the electrolyte, one or more conductive salts optionally present in an effective amount up to the solubility limit thereof in the electrolyte, a wetting agent in an amount up to 10 g/l, hydrogen ions present in an amount to provide a pH on the acid side, and at least one bath soluble EDTA additive present in an effective amount sufficient to increase the tolerance of the electrolyte to the presence of deleterious contaminating metal ions and organic contaminants, said EDTA additive having the structural formula:

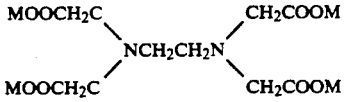

wherein M is hydrogen, an alkali metal or an alkaline earth metal.

8. The electrolyte of claim 7 in which the additive is ethylenediaminetetraacetic acid disodium salt.

9. The electrolyte as defined in claim 7 in which said EDTA additive is present in an amount ranging from 0.1 to 200 g/l.

10. The electrolyte as defined in claim 9 in which said EDTA additive is present in an amount ranging from about 15 to 30 g/l.

11. The electrolyte of claim 7 wherein the molar ratio of chromium ions to complexing agent is greater than 1:0.1.

12. An improved process for chromium plating with an aqueous acidic trivalent chromium electrolyte which comprises the steps of adding to an electrolyte consisting essentially of trivalent chromium ions and a water soluble complexing agent for maintaining the trivalent chromium ions in solution, at least one bath soluble EDTA additive in an amount effective to at least partially mask the detrimental effects of contaminating metal ions and organic impurities on the chromium plate, said EDTA additive having the structural formula:

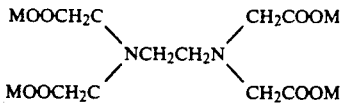

wherein M is hydrogen, an alkali metal or an alkaline earth metal, and effecting electrolysis of said electrolyte to electrodeposit chromium on a work piece.

13. The improved process of claim 12 wherein the electrolyte is maintained at a temperature of about 10°-90° C. and electrolysis is effected at a current density of 40 to 250 amperes per square foot.

14. An improved process for chromium plating with an aqueous acidic trivalent chromium electrolyte which comprises the steps of adding to an electrolyte consisting essentially of chromium sulfate, sodium sulfate, boric acid, thiorea, sodium 2-ethylhexyl sulfate, and water, at least one bath soluble EDTA additive in an mount effective to at least partially mask the detrimental effects of contaminating metal ions and organic impurities on the chromium plate, said EDTA additive having the structural formula:

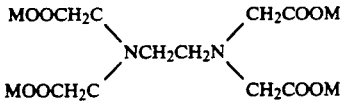

wherein M is hydrogen, an alkali metal or an alkaline earth metal, and effecting electrolysis of said electrolyte to electrodeposit chromium on a work piece.

* * * * *

UNITED STATES PATENT AND TRADEMARK OFFICE

CERTIFICATE OF CORRECTION

PATENT NO. : 5,196,109

DATED : March 23, 1993

INVENTOR(S) : Geoffrey Scott

It is certified that error appears in the above-identified patent and that said Letters Patent is hereby corrected as shown below:

Column 14,
In Claim 14, line 5, delete "thiorea" and insert in lieu thereof --thiourea--

Signed and Sealed this

Sixteenth Day of November, 1993

Bruce Lehman

*Attest:*

BRUCE LEHMAN

*Attesting Officer*

*Commissioner of Patents and Trademarks*